US010871748B2

(12) United States Patent
Baebler et al.

(10) Patent No.: US 10,871,748 B2
(45) Date of Patent: Dec. 22, 2020

(54) SAFETY VALVE FOR A TIMEPIECE

(71) Applicant: Meco SA, Grenchen (CH)

(72) Inventors: Jean Baebler, Gumligen (CH); Christian Olvaszto, Grenchen (CH); Pierre Podvin, Morges (CH)

(73) Assignee: Meco SA, Grenchen (CH)

( * ) Notice: Subject to any disclaimer, the term of this patent is extended or adjusted under 35 U.S.C. 154(b) by 206 days.

(21) Appl. No.: 16/035,928

(22) Filed: Jul. 16, 2018

(65) Prior Publication Data

US 2019/0025764 A1 Jan. 24, 2019

(30) Foreign Application Priority Data

Jul. 20, 2017 (EP) ..... 17182439

(51) Int. Cl.
*G04B 37/10* (2006.01)

(52) U.S. Cl.
CPC ..... *G04B 37/103* (2013.01)

(58) Field of Classification Search
CPC ..... G04B 37/088; G04B 37/02; G04B 37/10; G04B 37/103; G04B 37/106; F16K 17/02
USPC ..... 368/291, 289–290, 288, 308, 319–321
See application file for complete search history.

(56) References Cited

U.S. PATENT DOCUMENTS 4,292,682 A * 9/1981 Wenger ..... G04B 37/106 368/289
5,257,247 A * 10/1993 Miche ..... G04B 37/103 368/290
5,383,166 A 1/1995 Gallay
6,137,750 A * 10/2000 Rieben ..... G04B 37/103 368/290
6,200,020 B1 * 3/2001 Rieben ..... G04B 37/10 368/290
9,123,483 B2 * 9/2015 Ferri ..... H01H 13/06
10,152,024 B2 * 12/2018 Baebler ..... G04B 3/041
2019/0025763 A1 * 1/2019 Baebler ..... G04B 37/10
(Continued)

FOREIGN PATENT DOCUMENTS

CH 703 455 A1 1/2012
EP 0 556 155 A1 8/1993
JP 54-91150 U 6/1979

OTHER PUBLICATIONS

European Search Report dated Feb. 16, 2018 in European Application 17182439.4 filed on Jul. 20, 2017(with English Translation of Categories of Cited Documents).

*Primary Examiner* — Edwin A. Leon
(74) *Attorney, Agent, or Firm* — Oblon, McClelland, Maier & Neustadt, L.L.P.

(57) ABSTRACT

A crown head for a timepiece includes a cap, a tube secured in a timepiece case, a central pipe engaged with the tube, and a safety valve with a discharge channel in fluid communication with the inside of the case when the valve is in an open configuration, to discharge excess fluid. The safety valve also includes a piston fitted inside the central pipe and an elastic member to cooperate with the piston, which can be displaced axially according to the pressure variations inside the case. The crown head also includes a blockage which prevents separation of the cap and the tube. The blockage includes a shoulder arranged on the inner wall of the tube, and includes a support surface against which part of the piston can abut, and a rim provided at the base of the central pipe to abut against a shoulder on the piston.

11 Claims, 2 Drawing Sheets

(56) References Cited

U.S. PATENT DOCUMENTS

2019/0137936 A1* 5/2019 Podvin ..... F16K 17/04
2019/0137937 A1* 5/2019 Podvin ..... G04B 37/103

* cited by examiner

SAFETY VALVE FOR A TIMEPIECE

This application claims priority from European Patent Application No. 17182439.4 filed on Jul. 20, 2017, the entire disclosure of which is incorporated herein by reference.

FIELD OF THE INVENTION

The present invention relates to a safety valve configured to be integrated in a crown head of a timepiece. This type of valve is particularly well suited for diving watches.

BACKGROUND OF THE INVENTION

It is known to provide a watch case with a crown head comprising a valve, in order to make it possible either to blow a gas into the case, so as to make a pressure greater than ambient pressure exist inside it, thus preventing the penetration of water, steam or dust inside the case, or on the contrary to create a vacuum inside it for the purpose of protecting the movement against the effects of the air contained in the case when it is closed. In the screwed-down position, a crown head of this type ensures reinforced sealing of the timepiece. In the unscrewed position, the crown head is in an open configuration and makes it possible to discharge excess fluid. When it is unscrewed, the crown head can also adopt different axial positions, with each axial position making it possible to implement an adjustment mode.

However, when a user unscrews the crown head by unscrewing its cap, he risks unscrewing the cap completely, thus giving rise to separation of the cap and the remainder of the crown head. The user then risks losing the cap, or at least having difficulties in refitting it correctly, whilst also putting the seal back into place.

SUMMARY OF THE INVENTION

An objective of the present invention is consequently to propose a crown head which prevents complete unscrewing of its cap.

For this purpose, a crown head for a timepiece is proposed, in particular for a diving watch, comprising a cap comprising a cover and an axial skirt, a tube which is designed to be secured in a case of the timepiece, a sealing gasket disposed between the tube and the axial skirt, and a central pipe which is designed to be engaged with the tube. The central pipe and the cap form an assembly which can be placed in different axial positions relative to the tube. The crown head also comprises a safety valve comprising a discharge channel which is designed to be able to be in fluid communication with the inside of the case when the valve is in an open configuration, in order to discharge excess fluid, the said safety valve also comprising a piston fitted inside the central pipe and an elastic member designed to cooperate with the piston, which is configured to be displaced axially according to the pressure variations inside the case. The crown head also comprises blocking means which prevent separation of the cap and the tube.

According to the invention, the blocking means comprise a shoulder arranged on the inner wall of the tube, and comprising a support surface against which part of the piston can abut, and a rim which is provided at the base of the central pipe, and is designed to abut against a shoulder provided on the piston.

According to an advantageous embodiment, the part of the piston which can abut against the shoulder of the tube is formed by a head of a guide screw integral with the piston.

According to a first variant embodiment, the safety valve can also comprise a pressure regulator arranged inside the discharge channel in order to control the output speed of the fluid.

According to an advantageous embodiment, the pressure regulator comprises a ball which is designed to cooperate with a ball seat. This ball is arranged on the ball seat such as to obstruct the passage of a fluid in the discharge channel when the internal pressure upstream from the ball is lower than a predetermined value. The ball is dislodged from its seat when the said internal pressure exceeds the predetermined value, in order to establish the said fluid communication.

According to an advantageous embodiment, the ball seat, the tube and the axial skirt have symmetry of revolution relative to the axis of rotation (A) of the cap. The seat comprises a central opening corresponding to the input of the discharge channel, as well as a support surface which is designed to be in contact with the ball.

According to a second variant embodiment, the safety valve can also comprise a membrane which is designed to be permeable to gases, and to establish fluid communication from the inside of the case to the outside, when the said internal pressure exceeds a predetermined value, and which membrane is impermeable to liquids which circulate from the outside of the case to the inside of the case.

According to an advantageous embodiment, the piston and the elastic member form an assembly which is designed firstly to be able to activate the displacement of a control rod, and secondly for regulation of the pressure inside the case.

The present invention also relates to a timepiece, in particular a diving watch, comprising at least the adjustment crown head as defined above.

BRIEF DESCRIPTION OF THE DRAWINGS

Other characteristics and advantages of the present invention will become apparent from reading several embodiments provided purely by way of non-limiting examples and with reference to the appended drawings in which.

DETAILED DESCRIPTION OF PREFERRED EMBODIMENTS

Figure 1:
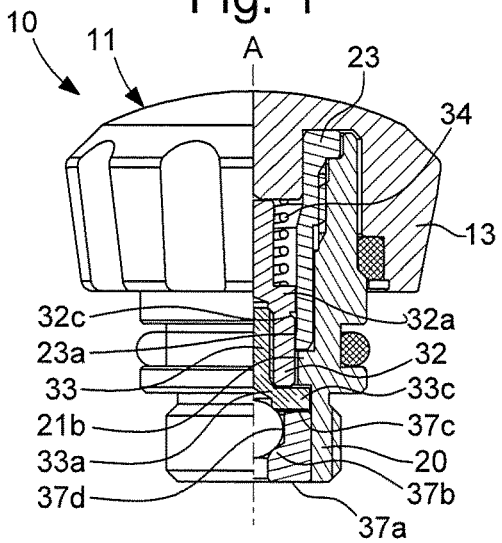
FIG. 1 represents a view in half cross-section of an adjustment crown head in a screwed-down position with the safety valve in a closed configuration according to a first embodiment.

An adjustment crown head 10, in particular for a diving watch according to a first embodiment of the invention, will now be described with reference to FIGS. 1 to 3*c*.

The crown head 10 comprises a tube 20 which is designed to be secured on a watch case (not represented) by screwing or driving into the middle of the case. The tube 20 comprises a tapped part 21*a* which is disposed in its inner wall 21, as well as a bulge 22*a* disposed around the circumference of its outer wall 22. The crown head 10 also comprises a cap 11, which comprises a cover 12 and an axial skirt 13 with symmetry of revolution around the axis of rotation A of the cap 11. The cover 12 and the axial skirt 13 of the cap 11 define a cavity 15 in the cap 11. The crown head 10 also comprises a central pipe 23 which is arranged in the cavity 15 in the cap 11, and is integral with the latter. On its outer wall 25, the central pipe 23 comprises a threaded part 25*a* which is screwed into the tapped part 21*a* of the tube 20.

The adjustment crown head 10 also comprises a sealing gasket 17 interposed between the axial skirt 13 of the cap 11 and the tube 20, such as to guarantee the sealing of the crown head, irrespective of whether the cap 11 is in a first axial position, in which the crown head is screwed down, or in a second axial position in which the crown head is unscrewed. In this embodiment, this sealing gasket 17 is an O-ring seal. This sealing gasket 17 is arranged between a circular shoulder 14 provided on the axial skirt 13, and a retention ring 18 with an annular form. This ring 18 is secured, for example by being driven, in a groove 16 with a corresponding form which is towards the base of the axial skirt 13 opposite the tube 20.

With reference to FIG. 1, the sealing gasket 17 is pressurised by the bulge 22*a* of the tube 20, such that the sealing properties are the best possible when the cap 11 is in the first axial position in which the crown head 10 is in a so-called screwed-down configuration.

Figure 2:
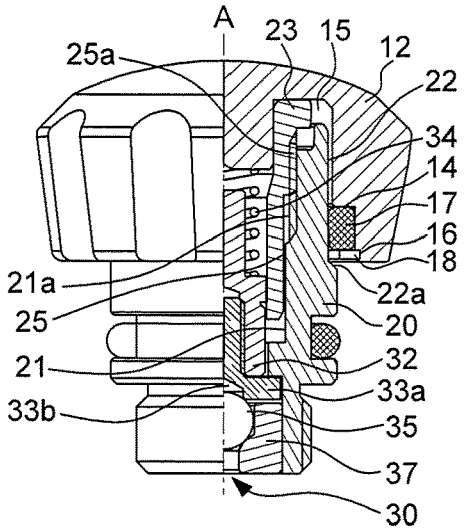
FIG. 2 represents a view similar to FIG. 1, with the adjustment crown head in unscrewed position and the safety valve in an open configuration.

The adjustment crown head 10 also comprises a piston 32 which is accommodated in a central opening in the central pipe 23, as well as an elastic member, for example a compression spring 34 of the helical type, in a cavity defined by the cap-pipe assembly on the one hand and by the piston 32 on the other hand. The spring 34 is compressed axially between the cover 12 of the cap 11 and a shoulder 32*a* of the piston 32, and in particular it makes it possible to space the cap 11 from the shoulder of the piston 32. The piston 32 connects the cap 11 kinematically to a control rod (not represented) of the timepiece movement which is accommodated in the watch case. This control rod allows the wearer to carry out different controls according to the axial position of the cap 11 relative to the tube 20, for example winding the watch when the cap 11 is in a first axial position as illustrated by FIG. 1, or certain corrections, such as that of the time, when the cap 11 is in a second axial position as illustrated by FIG. 2.

The piston 32 and the spring 34 are also involved in the regulation of the pressure inside the watch case, thanks to a safety valve, a detailed description of which is provided hereinafter.

The piston and the spring thus form an assembly which has the advantage of being involved in carrying out two main functions which are independent from one another, i.e.: the activation of the control rod in order to carry out various adjustments on the one hand, and regulation of the pressure inside the watch case on the other hand.

In addition, the crown head 10 comprises blocking means which prevent the cap 11 and the tube 20 from becoming separated.

According to the invention, the blocking means comprise a shoulder 21*b* arranged on the inner wall 21 of the tube 20, and comprising a support surface against which part of the piston 32 can abut. The blocking means also comprise a rim 23*a* provided at the base of the central pipe 23, and designed to abut against the shoulder 32*a* provided on the piston 32.

Advantageously, the part of the piston 32 which can abut against the shoulder 21*b* of the tube 20 is formed by the head 33*a* of a guide screw 33 which is integral with the piston 32. More particularly, the piston 32 comprises tapping into which the guide screw 33 is screwed. The guide screw 33 also comprises a recessed central part 33*b* in the form of a cone, as well as a peripheral annular part 33*c* which extends as far as the inner wall 21 of the tube 20. The peripheral annular part 33*c* of the head 33*a* of the guide screw 33 is designed to abut against this shoulder 21*b* of the tube 20 when the cap 11 is brought into its second axial position. In addition, the rim 23*a* at the base of the central pipe 23 is designed to engage in a notch 32*c* provided for this purpose below the lower face of the shoulder 32*a* of the piston 32, when the said rim 23*a* abuts against the lower face of the shoulder 32*a* of the piston 32. Thus, when the crown head 10 is unscrewed, the central pipe 23 will be blocked by the shoulder 32*a* of the piston 32, which itself will be blocked since it is integral with the guide screw 33, which itself is blocked by the shoulder 21*b* of the tube 20. This makes it possible to avoid excessive unscrewing of the crown head 10, such as to prevent the cap 11 from becoming separated from the tube 20.

In order to subject the seals of the crown head to less stress, and to regulate better the pressure variations inside the watch case, caused for example by raising the plunger to the surface, a safety valve is incorporated in the crown head.

The safety valve comprises a discharge channel which is designed to be able to be in fluid communication with the inside of the watch case when the valve is in an open configuration, in order to discharge excess pressure in the case.

According to a variant, the valve comprises a pressure regulator arranged inside the discharge channel, in order to control the speed of output of a fluid which is in the form of a gas, preferably helium. For this purpose, the pressure regulator comprises a ball 35 which cooperates with a ball seat 37 fitted at the input 30 of the discharge channel.

The ball seat 37, the tube 20 and the axial skirt 13 have symmetry of revolution relative to the axis of rotation A of the cap 11. The ball and its seat can for example be based on metal, ceramics, or thermoplastic materials inter alia.

The seat 37 comprises an annular base 37*a* comprising an opening, the axis of revolution of which coincides with the axis of rotation A of the cap 11. The diameter of this opening is smaller than the diameter of the ball 35. This opening corresponds to the input 30 of the discharge channel of the valve. The seat 37 also comprises an inclined circular support surface 37*b* which is designed to be in contact with the ball 35, a cylindrical wall 37*d* in order to ensure the centring of the ball 35 relative to the axis of rotation A of the cap 11, and a peripheral support surface 37*c* arranged opposite the peripheral annular part 33*c* of the head 33*a* of the guide screw 33.

The head 33*a* of the guide screw 33 is disposed opposite the ball 35. The configuration and the positioning of the guide screw 33 and of the seat 37 make it possible to form a cage delimiting a space inside which the ball 35 can be displaced under the effect of the pressure.

The ball 35 is arranged on its seat 37 such as to obstruct the passage of the gas in the discharge channel when the pressure in the watch case, upstream from the ball, is lower than a predetermined value. This value can be adapted to the circumstances, this adaptation being carried out by the selection of the compression spring 34 which maintains an end of the piston 32 supported against the ball 35. The properties of the spring 34 are thus selected to control the stress exerted by the piston 32 on the ball 35, in order to control the opening pressure of the valve. It will be noted that the ball is always subjected to stress by the spring 34 when the crown head 10 is in a screwed-down configuration (FIG. 1), whereas the spring 34 is adapted so that the ball 35 is free, or under slight stress, when the crown head 10 is in an unscrewed configuration (FIG. 2).

Figure 3A:
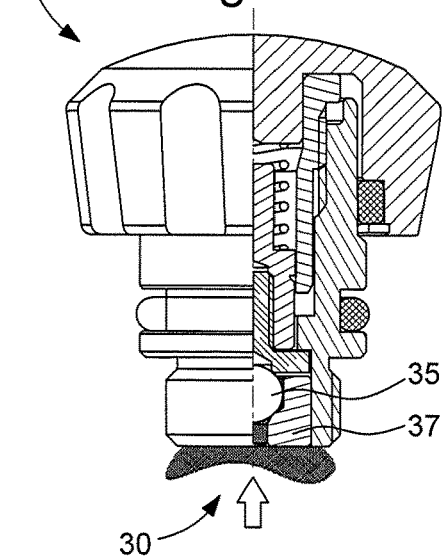
FIGS. 3*a*, 3*b* and 3*c* are each identical to FIG. 2, and represent schematically the progression of a fluid, for example helium, in the discharge channel.
Figure 3B:
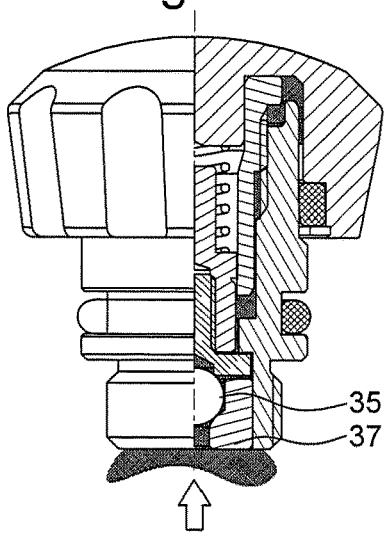
Figure 3C:
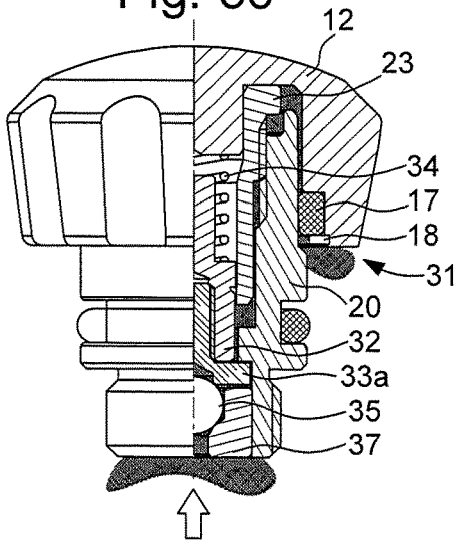

With reference to FIGS. 3*a*, 3*b*, and 3*c*, the crown head 10 is in an unscrewed configuration whereas the pressure inside the watch case exceeds a critical threshold. Under the effect of this excess pressure, the ball 35 is dislodged from its seat 37, which allows the gas to access the input 30 of the discharge channel (FIG. 3*a*), then to be displaced along this channel (FIG. 3*b*), as far as the output 31 of the channel (FIG. 3*c*) so as to permit the discharge of the gas from the valve.

An adjustment crown head 10 for a diving watch according to a second embodiment will now be described with reference to FIGS. 4 and 5. The operating principle of the means for blocking the crown head according to this embodiment is identical to that which has just been described. Thus, for reasons essentially of concision and clarity, only the structural differences will be described hereinafter.

Figure 4:
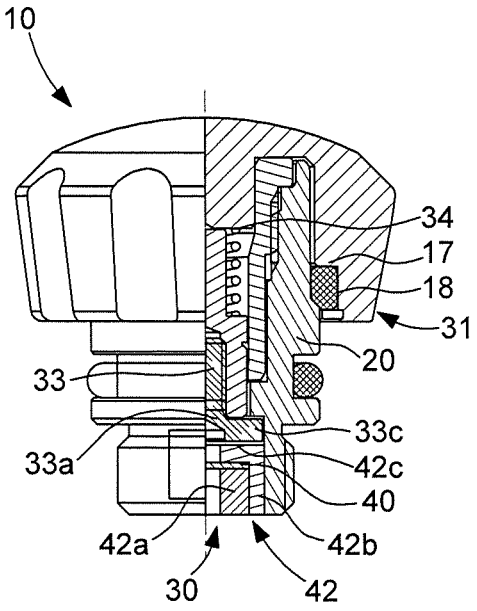
FIG. 4 represents a view in half cross-section of an adjustment crown head in a screwed-down position according to another embodiment, with the safety valve in a closed configuration.
Figure 5:
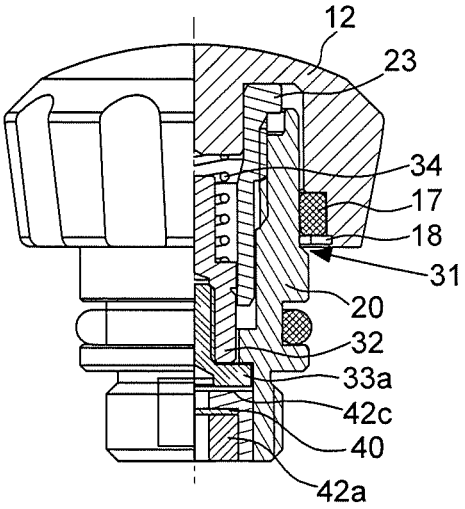
FIG. 5 represents a view similar to FIG. 4, with the adjustment crown head in an unscrewed position and the safety valve in an open configuration.

According to FIGS. 4 and 5, which illustrate the adjustment crown head in a screwed-down and unscrewed configuration respectively, the safety valve comprises a membrane 40 which is designed to be permeable to gases and to establish fluid communication from the inside of the case to the outside, when the said internal pressure exceeds a predetermined value, and to be impermeable to liquids which circulate from the outside of the case to the inside of the case. For this purpose, a membrane support 42 is fitted at the input 30 of the discharge channel, inside the base of the tube 20. The membrane support 42 comprises an annular base 42*a* on which the edge of the membrane 40 is supported, and comprises an opening, the axis of revolution of which coincides with the axis of rotation A of the cap 11. This opening corresponds to the input 30 of the discharge channel of the valve. The membrane support 42 also comprises a shouldered ring 42*b* designed to grip the membrane 40 against the base 42*a*, and the shoulder 42*c* of which is disposed opposite the peripheral annular part 33*c* of the head 33*a* of the guide screw 33. A gap is provided between the shoulder 42*c* and the peripheral annular part 33*a*, in order to form a part of the discharge channel. The membrane consists for example of a polymer film which is impermeable to water and permeable to gases. Typically, the polymer film is supported by a substrate which is porous to gases. Advantageously, this membrane can be a membrane sold by the company Gore under the reference "Acoustic vent GAW331".

When the crown head 10 is in an unscrewed configuration, whereas the pressure inside the watch case exceeds a critical threshold, the gas comes into contact with the membrane 40 which is permeable to gases, thus allowing the gas to pass through it and to be displaced along the discharge channel formed by the various elements in the crown head, as far as the output 31 of the channel, in order to permit the discharge of the gas from the valve.

In order to prevent the cap 11 from becoming separated from the tube 20, excessive unscrewing of the crown head 10 is prevented thanks to blocking means similar to those of the first variant.

It will be appreciated that the invention is not limited to the embodiments described with reference to the figures, and variants could be envisaged without departing from the context of the invention. For example, the piston can be in a single piece, or can be constituted by a plurality of assembled parts.

What is claimed is:

1. A crown head for a timepiece, in particular for a diving watch, comprising:

a cap comprising a cover and an axial skirt;

a tube which is designed to be secured in a case of the timepiece;

a sealing gasket disposed between the tube and the axial skirt;

a central pipe which is designed to be engaged with the tube, the central pipe and the cap forming an assembly which can be placed in different axial positions relative to the tube;

a safety valve comprising a discharge channel which is designed to be able to be in fluid communication with the inside of the case when the valve is in an open configuration, in order to discharge excess fluid, said safety valve also comprising a piston fitted inside the central pipe and an elastic member designed to cooperate with the piston at a first end of the piston, which is configured to be displaced axially according to pressure variations inside the case; and blocking means which prevent separation of the cap and the tube, wherein the blocking means comprise a shoulder arranged on an inner wall of the tube, and comprising a support surface against which part of the piston can abut, and a rim which is provided at the base of the central pipe, and is designed to abut against a shoulder provided on the piston, wherein the safety valve also comprises a pressure regulator arranged inside the discharge channel and facing a second end of the piston in order to control the output speed of the fluid, the second end of the piston being opposite to the first end in an axial direction.

2. The crown head according to claim 1, wherein the part of the piston which can abut against the shoulder of the tube is formed by a head of a guide screw integral with the piston.

3. The crown head according to claim 1, wherein the pressure regulator comprises a ball which is designed to cooperate with a ball seat, the ball being arranged on the ball seat such as to obstruct the passage of a fluid in the discharge channel when the internal pressure upstream from the ball is lower than a predetermined value, the ball being dislodged from the ball seat when the internal pressure exceeds the predetermined value, in order to establish the fluid communication.

4. The crown head according to claim 3, wherein the ball seat, the tube and the axial skirt have symmetry of revolution relative to the axis of rotation (A) of the cap, the ball seat comprising a central opening corresponding to the input of the discharge channel, as well as a support surface which is designed to be in contact with the ball.

5. The crown head according to claim 1, wherein the pressure regulator is a membrane which is designed to be permeable to gases, and to establish fluid communication from the inside of the case to the outside, when the internal pressure exceeds a predetermined value, and which membrane is impermeable to liquids which circulate from the outside of the case to the inside of the case.

6. The crown head according to claim 1, wherein the piston and the elastic member form an assembly which is designed firstly to be able to activate the displacement of a control rod, and secondly for regulation of the pressure inside the case.

7. A timepiece, comprising:

a crown head that comprises:

a cap comprising a cover and an axial skirt;

a tube which is designed to be secured in a case of the timepiece;

a sealing gasket disposed between the tube and the axial skirt:

a central pipe which is designed to be engaged with the tube, the central pipe and the cap forming an assembly which can be placed in different axial positions relative to the tube;

a safety valve comprising a discharge channel which is designed to be able to be in fluid communication with the inside of the case when the valve is in an open configuration, in order to discharge excess fluid, said safety valve also comprising a piston fitted inside the central pipe and an elastic member designed to cooperate with the piston at a first end of the piston, which is configured to be displaced axially according to pressure variations inside the case; and blocking means which prevent separation of the cap and the tube, wherein the blocking means comprise a shoulder arranged on an inner wall of the tube, and comprising a support surface against which part of the piston can abut, and a rim which is provided at the base of the central pipe, and is designed to abut against a shoulder provided on the piston, wherein the safety valve also comprises a pressure regulator arranged inside the discharge channel and facing a second end of the piston in order to control the output speed of the fluid, the second end of the piston being opposite to the first end in an axial direction.

8. The timepiece according to claim 7, wherein the timepiece is a diving watch.

9. The crown head according to claim 1, wherein the elastic member is a compression spring and the piston extends into the compression spring.

10. The crown head according to claim 2, wherein the guide screw comprises a recessed central part and a peripheral annular part which extends to the inner wall of the tube.

11. The crown head according to claim 10, wherein the peripheral annular part of the guide screw abuts against the shoulder of the tube when the cap is in an unscrewed axial position.

* * * * *